US011717830B2

(12) United States Patent
Li et al.

(10) Patent No.: US 11,717,830 B2
(45) Date of Patent: Aug. 8, 2023

(54) OPEN MICROFLUIDIC SYSTEM AND VARIOUS FUNCTIONAL ARRANGEMENTS THEREFORE

(71) Applicant: Wisconsin Alumni Research Foundation, Madison, WI (US)

(72) Inventors: Chao Li, Madison, WI (US); David J. Beebe, Monona, WI (US); Duane S. Juang, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 502 days.

(21) Appl. No.: 16/913,229

(22) Filed: Jun. 26, 2020

(65) Prior Publication Data

US 2021/0101149 A1 Apr. 8, 2021

Related U.S. Application Data

(60) Provisional application No. 62/868,378, filed on Jun. 28, 2019.

(51) Int. Cl.
*B01L 3/00* (2006.01)

(52) U.S. Cl.
CPC ... *B01L 3/502761* (2013.01); *B01L 3/502707* (2013.01); *B01L 3/502746* (2013.01); *B01L 3/567* (2013.01); *B01L 2200/0652* (2013.01); *B01L 2200/12* (2013.01); *B01L 2300/088* (2013.01); *B01L 2300/16* (2013.01); *B01L 2300/161* (2013.01); *B01L 2400/086* (2013.01); *B01L 2400/088* (2013.01)

(58) Field of Classification Search
CPC ..... B01L 2200/0652; B01L 2200/0694; B01L 2200/12; B01L 2300/088; B01L 2300/089; B01L 2300/16; B01L 2300/161; B01L 2300/165; B01L 2400/0688; B01L 2400/086; B01L 2400/088; B01L 3/502707; B01L 3/502746; B01L 3/502761; B01L 3/502792; B01L 3/567
See application file for complete search history.

(56) References Cited

U.S. PATENT DOCUMENTS

2008/0032390 A1* 2/2008 Meyvantsson .... B01L 3/502753 435/287.1
2013/0130232 A1 5/2013 Weibel et al.
(Continued)

FOREIGN PATENT DOCUMENTS

WO 2010017578 2/2010
WO WO-2019007958 A1 * 1/2019 ..... B01L 3/50273

OTHER PUBLICATIONS

Li, Chao et al., "Exclusive Liquid Repellency: An Open Multi-Liquid-Phase Technology for Rare Cell Culture and Single-Cell Processing", ACS Appl. Mater. Interfaces 2018, 10, 17065-17070.
(Continued)

*Primary Examiner* — Jennifer Wecker
(74) *Attorney, Agent, or Firm* — Boyle Fredrickson, S.C.

(57) ABSTRACT

An open microfluidic system is provided. The open microfluidic system including the extreme wettability of exclusive liquid repellency (ELR), open microchannels with high lateral resolution and low profile, various valve arrangements, capable of a broad range flow rates, and capable of spatially and temporally trapping particles in open fluid.

23 Claims, 7 Drawing Sheets

(56) References Cited

U.S. PATENT DOCUMENTS

| | | | | |
|---|---|---|---|---|
| 2015/0306598 | A1 | 10/2015 | Khandros et al. | |
| 2016/0084750 | A1* | 3/2016 | Wang | B01L 3/502707 156/245 |
| 2018/0104689 | A1 | 4/2018 | Borenstein et al. | |
| 2018/0311671 | A1 | 11/2018 | Cook et al. | |

OTHER PUBLICATIONS

PCT/U2020/040014, International Search Report and Written Opinion, dated Oct. 15, 2020, 11 pages.

* cited by examiner

OPEN MICROFLUIDIC SYSTEM AND VARIOUS FUNCTIONAL ARRANGEMENTS THEREFORE

CROSS-REFERENCE TO RELATED APPLICATION

This application claims benefit from U.S. Provisional Application Ser. No. 62/868,378, filed Jun. 28, 2019, the entirety of which is incorporated herein.

REFERENCE TO GOVERNMENT GRANT

This invention was made with government support under CA181648 awarded by the National Institutes of Health and W81XWH-16-1-0514 awarded by the ARMY/ARO. The government has certain rights in the invention.

FIELD OF THE INVENTION

This invention related generally to microfluidics, and in particular, to an open microfluidic system including the extreme wettability of exclusive liquid repellency (ELR), open microchannels with high lateral resolution and low profile and with various valve arrangements, capable of a broad range flow rates, and capable of spatially and temporally trapping particles.

BACKGROUND AND SUMMARY OF THE INVENTION

Open microfluidics has been defined as a microfluidic system with at least one solid boundary confining the fluid removed, exposing the fluid either to air (i.e., single-liquid-phase) or a second fluid (i.e., multi-liquid-phase). One disadvantage of single-liquid-phase open systems is their sensitivity to evaporation. To overcome this limitation many open microfluidic systems employ an oil overlay (similar to the oil-overlaid microdroplets used for decades for the in vitro study of early embryo development) to prevent detrimental fluid loss via evaporation and airborne contamination through the liquid-air interface. Important advantages of open microfluidics include accessibility, bubble elimination and ease of use. The liquid/air or liquid/liquid interface above and surrounding the channel provides direct physical access to the fluid of interest, e.g., enabling localized interrogation of cellular samples with their biophysics or biochemistry. Also, without the need to bond to another surface, open microfluidic devices are generally easy-to-make and easy-to-use (e.g., elimination of bubble trapping and associated device failures), reducing the adoption barrier to end users.

Under oil open microfluidics has been limited in its functional/operational range due to the lack of lateral flow. Recently, lateral flow was introduced to under oil open microfluidics to expand its functionality. Fundamental to most microfluidic systems is their ability to control mass transport (e.g., maintaining steady flow, varying flow rate, and turning flow on and off). However, reported under oil open-channel systems exhibit a limited flow range (from both the upper and lower limits) thus limiting potential applications. For example, the maximum flow rate is several orders of magnitude lower than the typical range for closed channels. The reported techniques form channels via a two-step process whereby the channels are initially filled in air and then subsequently overlaid with oil. This two-step process presents a number of technical challenges that limit the scope of their geometries and application. From a practical operational perspective, the initial in-air step (prior to the introduction of an oil overlay) restricts the channel width to the millimeter scale due to volume loss via evaporation. Millimeter scale channels are limited in their ability to spatially and temporally organize cellular samples (e.g., mammalian and bacterial cells are less than 10 μm), and flexibility in control of mass transport. In addition to extending the range of flow rates, open microchannels should also be able to provide the ability to turn flow on and off.

Therefore, it is a primary object and feature of the present invention to provide an open microfluidic system that allows for increased accessibility, minimized evaporation and airborne contamination, and ease of use over prior systems.

It is a further object and feature of the present invention to provide an open microfluidic system that allows for a high lateral resolution of fluidic channels (e.g., a few microns in channel width, spacing, and height).

It is a still further object and feature of the present invention to provide an open microfluidic system that allows for confinement of various cellular samples (e.g., mammalian cells, bacteria, and fungi) in open fluid.

It is a still further object and feature of the present invention to provide an open microfluidic system that enables flow control covering several orders of magnitude.

It is a still further object and feature of the present invention to provide an open microfluidic system that includes various valve arrangements with the ability to reversibly turn fluid flow through the system on and off.

It is a still further object and feature of the present invention to provide an open microfluidic system including a single-use valve for use in a sample loading for streamlined multi-step assays.

It is a still further object and feature of the present invention to provide an open microfluidic system that is simple to utilize and inexpensive to manufacture.

In accordance with the present invention, an open microfluidic system is provided. The open microfluidic system includes a microfluidic device having a reservoir adapted for receiving an oil therein. The reservoir is defined by a surface configured to repel an aqueous solution. A hydrophilic input and a hydrophilic output are patterned on the surface. The output is spaced from the input. A hydrophilic strip interconnects the input and the output.

The strip includes a first channel having a first end connected to the input, a second channel having a first end connected to the output, and a valve configured to selectively fluidically connect the second ends of the first and second channel. The valve includes a second end of the first channel and a second end of the second channel. The valve may have one of plurality of configurations. By way of example, the valve may include a dried reagent fluidically interconnecting the second end of the first channel and the second end of the second channel. Fluid flowing over the dried reagent picks-up and re-dissolves the dried reagent therein, thereby exposing a portion of the surface between the first and second hydrophilic channels and fluidically isolates the first channel from the second channel.

Alternatively, the second end of the second channel may have a horseshoe configuration. In addition, the second end of the first channel has a horseshoe configuration. A droplet having a first dimension may be deposited on the surface. When the droplet communicates with the second end of the first channel and the second end of the second channel, the valve is closed. When the droplet has a second dimension, the droplet fluidically isolates the second end of the first channel form the second end of the second channel, thereby opening the valve.

In accordance with a further aspect of the present invention, a method of fabricating an open microfluidic system is provided. The method includes the step of providing a microfluidic device including a reservoir defined by a surface configured to repel an aqueous solution. A hydrophilic input, a hydrophilic output and a hydrophilic strip interconnecting the input and output are patterned on the surface. The reservoir is filled with an oil. An input droplet of the aqueous solution is positioned on the input and an output droplet of the aqueous solution is positioned on the output. The input droplet and the output droplet are fluidically connected along the strip with the aqueous solution.

The step of fluidically connecting the input droplet and the output droplet along the strip includes the step of generating an external perturbation on the oil in the reservoir. The external perturbation on the oil may be generated by an anti-static gun Which repetitively pumps ionized air at the oil. The strip may include a valve, the valve having a first open configuration fluidically isolating the input from the output and a second closed configuration wherein the input and the output are in fluidic communication. The strip includes a first channel having a first end connected to the input and a second channel having a first end connected to the output. The valve is configured to selectively fluidically connect the first and second channels. The valve may include a second end of the first channel and a second end of the second channel. A dried reagent may fluidically interconnecting the second end of the first channel and the second end of the second channel. A fluid flowing over the dried reagent picks-up and re-dissolves the dried reagent therein so as to expose a portion of the surface between the first and second hydrophilic channels, thereby opening the valve.

Alternatively, the second end of the second channel may have a horseshoe configuration and the second end of the first channel may have a horseshoe configuration. The valve includes a droplet having a first dimension wherein the droplet communicates with the second end of the first channel and the second end of the second channel thereby closing the valve and a second dimension wherein the droplet fluidically isolates the second end of the first channel form the second end of the second channel thereby opening the valve.

In accordance with a still further aspect of the present invention, a single-use valve is provided. The valve includes a microfluidic device having a reservoir defined by a surface configured to repel an aqueous solution. The reservoir is configured for receiving oil therein. First and second hydrophilic channels are patterned on surface. The first and second hydrophilic channels spaced from each other. A dried reagent interconnects the first and second hydrophilic channels. Fluid flowing over the dried reagent picks-up and re-dissolves the dried reagent therein, thereby exposing a portion of the surface between the first and second hydrophilic channels and fluidically isolating the first hydrophilic channel from the second hydrophilic channel.

BRIEF DESCRIPTION OF THE DRAWINGS

The drawings furnished herewith illustrate a preferred methodology of the present invention in which the above advantages and features are clearly disclosed as well as others which will be readily understood from the following description of the illustrated embodiment.

In the drawings.

DETAILED DESCRIPTION OF THE DRAWINGS

ELR is a phenomenon observed in solid-liquid-liquid three phase systems, where a solid surface shows complete repellency to a liquid (with a contact angle (CA)=180°) when exposed to a second liquid. This phenomenon is observed when a particular thermodynamic boundary condition is satisfied, for example, by the equation:

$$\gamma_{S/Lcp}+\gamma_{Ldp/Lcp}\leq\gamma_{S/Ldp} \quad \text{Equation (1)}$$

wherein: γ is the interfacial tension; S is solid; Lcp is a liquid of continuous phase; and Ldp is a liquid of dispersed phase. ELR enables additional fluidic control, robust on-chip cell culture, and improved processing of rare cell samples in open aqueous fluid under oil.

In systems employing double-ELR, there is selective and complete repellency of two immiscible liquids from adjacent surfaces through surface chemistry patterning. Fluids are naturally contained on "preferred" surfaces of having a lower contact angle, which lowers free energy of the system. The boundary between surface patterns thus creates a virtual barrier (i.e., an energetic impediment) to fluid expansion from its footprint (i.e., the contact area between the fluid and its preferred surface). Double-ELR offers the theoretical maximum virtual barrier to both aqueous fluid and oil with a CA of 180° on their "non-preferred" surfaces (i.e., oil on glass, media on PDMS), and thus robustly confining the fluids to their preferred surfaces (i.e., oil on PDMS, media on glass). This virtual barrier is important to stabilize the three phase contact line. If fluid spreads from its original footprint, it is completely repelled by the non-preferred surface and recedes to the original pattern when the system is allowed to equilibrate. Double-ELR allows for spontaneous, uncompromised oil/media separation (without the need for surfactant), and thus, under oil sweep in open microfluidic designs. Under oil sweep is accomplished by simply dragging media across the patterned surface under oil, resulting in a specific volume of media (with or without cells) being spontaneously dispensed onto the patterned areas (i.e., microchannels or spots) and leaving the background clean with minimized sample loss and device fouling. As hereinafter described, by exploiting double-ELR and the technique of under oil sweep, open microchannels under oil are achieved with improved lateral resolution (for example, ~30 μm in both width and spacing), low profiles (for example, ~1 μm in height) capable of cell trapping, convective bulk flow covering eight orders of magnitude (for example, from 6 mL/min to 13 pL/min), and fully reversible fluidic valves.

Figure 1:
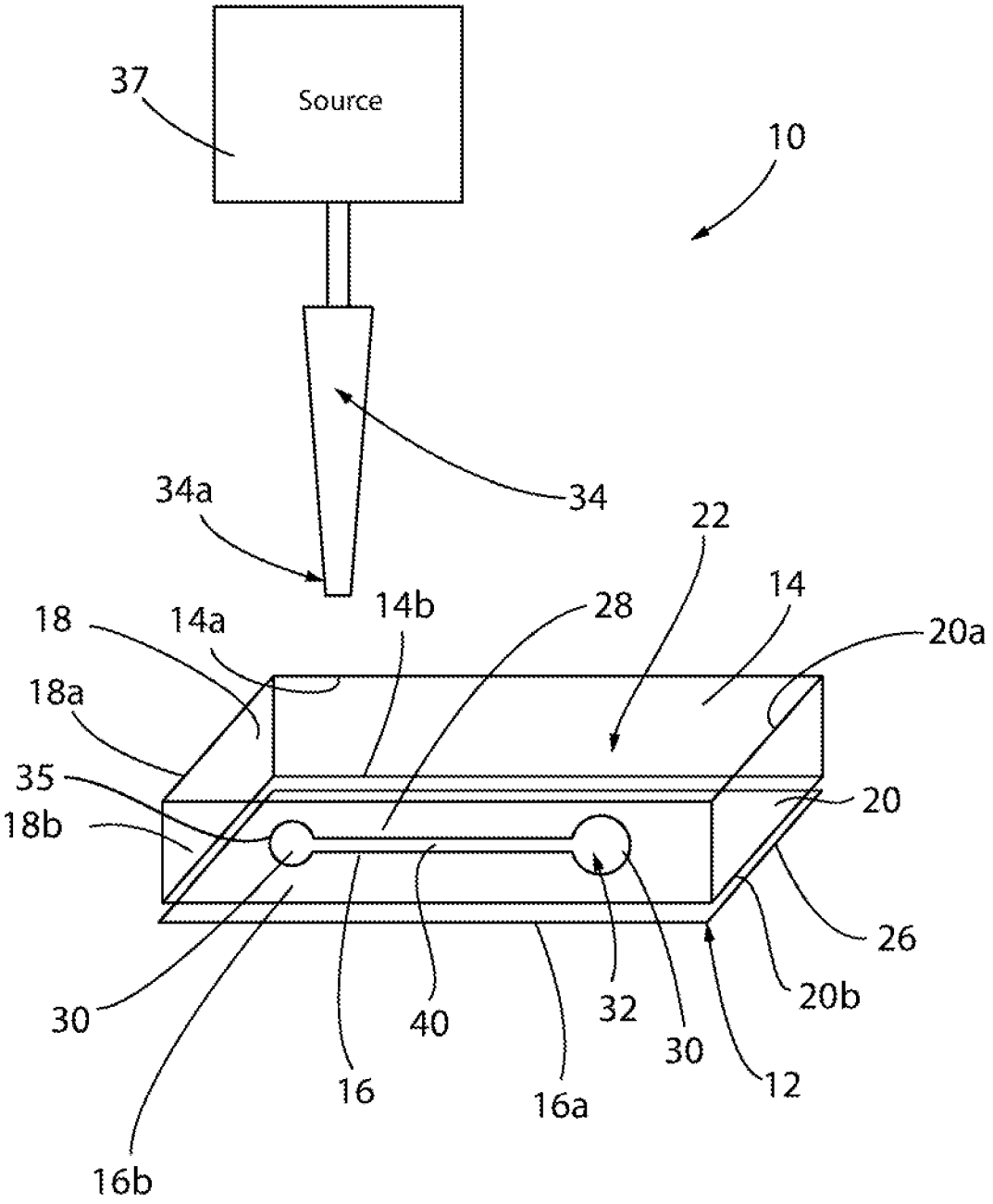
FIG. 1 is a schematic view of an open microfluidic system in accordance with the present invention.
Figure 2:
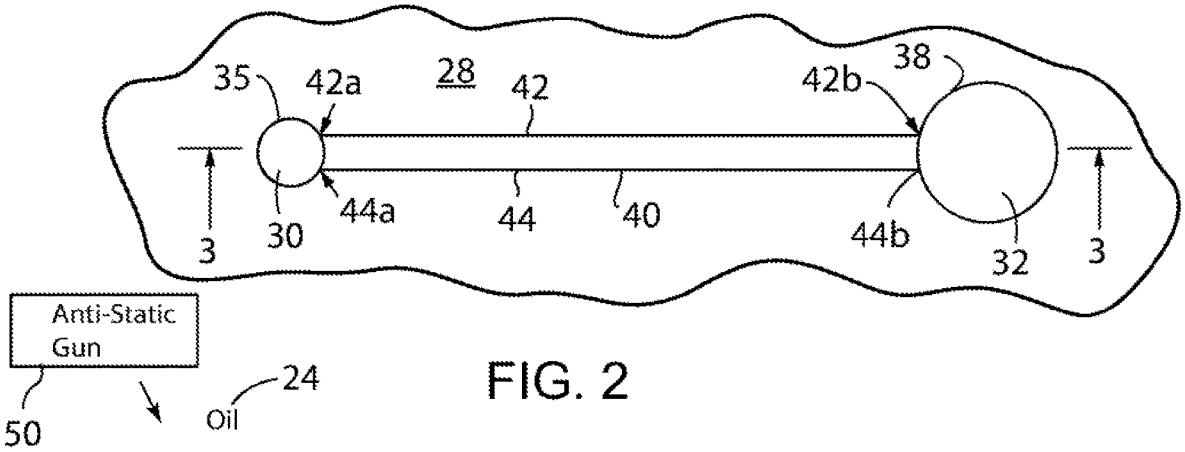
FIG. 2 is a top plan view showing a portion of the open microfluidic system of FIG. 1.
Figure 3:
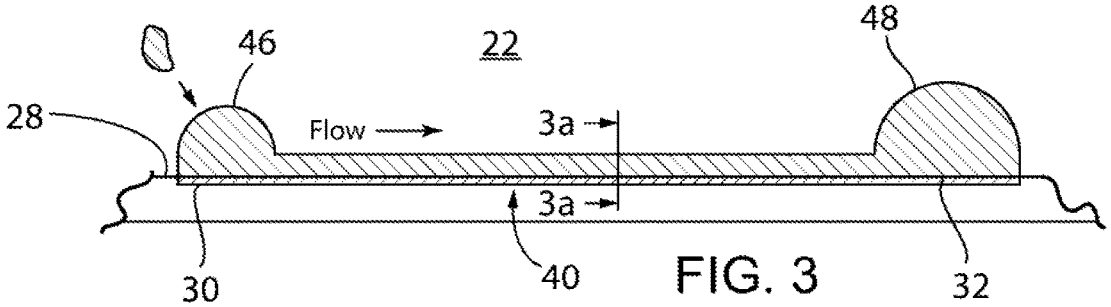
FIG. 3 is a cross-sectional view of the open microfluidic system of the present invention taken along line 3-3 of FIG. 1.

Referring to FIGS. 1-3, a schematic drawing depicting a system for carrying out a first aspect of the methodology of the present invention is generally designated by the reference numeral 10. System 10 includes microfluidic device 12 defined by first and second generally parallel, spaced side walls 14 and 16 respectively, interconnected by first and second generally parallel, spaced end walls 18 and 20, respectively. First and second side walls 14 and 16 respectively, and first and second end walls 18 and 20 respectively, define reservoir 22 for receiving a fluid, such as oil 24 or like, for reasons hereinafter described. It can be understood that oil 24 may be any liquid showing limited miscibility with water or any aqueous media. Upper edges 14*a* and 16*a* of first and second side walls 14 and 16 respectively, and upper edges 18*a* and 20*a* of end walls 18 and 20, respectively, define an opening 26 for allowing access to reservoir 22. Lower edges 14*b* and 16*b* of first and second side walls 14 and 16 respectively, and lower edges 18*b* and 20*b* of end walls 18 and 20, respectively, are interconnected by an exclusive liquid repellency (ELR) surface 28 which communicates with reservoir 22. ELR surface 28 is a hydrophobic solid surface having specific surface chemical and physical conditions intended to repel aqueous solutions, as hereinafter described. It can appreciated that while microfluidic device 10 has a generally rectangular, box-like configuration, other configurations are possible without deviating from the scope of the present invention.

In the depicted embodiment, surface patterning is provided on ELR surface 28 of open microfluidic system 10 of the present invention. For example, surface patterning of ELR surface 28 may be done on a PDMS-grafted glass substrate using a reusable PDMS stamp and O2 plasma diffusion treatment. More specifically, a hydrophilic input spot 30 is pre-patterned on ELR surface 28 of microfluidic device 12 at a selected first location and a hydrophilic output spot 32 is pre-patterned on ELR surface 28 of microfluidic device 12 at a selected second location, axially spaced from the first location. Input spot 30 has an outer periphery intersecting ELR surface 28 at boundary 35. Similarly, output spot 32 has an outer periphery intersecting ELR surface 28 at boundary 38. It is contemplated for output spot 32 to have a greater cross-sectional area than input spot 30, for reasons hereinafter described. However, input spot 30 and output spot 32 may be other configurations without deviating from the scope of the present invention.

Input spot 30 and output spot 32 are interconnected by a hydrophilic strip 40 pre-patterned on and extending axially along ELR surface 28. Strip 40 is defined by first and second, generally parallel edges 42 and 44, respectively, which intersect ELR surface 28. First and second edges 42 and 44, respectively, have corresponding first ends 42*a* and 44*a*, respectively, which intersect boundary 35 of input spot 32 and corresponding second ends 42*b* and 44*b*, respectively, which intersect boundary 38 of output spot 32. The functionality of microfluidics leverages channel dimensions of tens to hundreds of microns. By way of example, strip 40 has width ranging from 10 to 200 micrometers (μm). It is further contemplated for the surface patterning on ELR surface 28 to have other configurations. For example, strip 40 may be wider at second ends 42*b* and 44*b* and narrower at first ends 42*a* and 44*a* to promote passive pumping of an aqueous media in system 10, hereinafter described. In addition, it is contemplated to provide input and output spots 30 and 32, respectively, at different locations along strip 40, without deviating from the scope of the present invention.

In operation, reservoir 22 of microfluidic device 12 is filled with a selected fluid, such as oil 24. After flooding the reservoir 22 with oil 24, one of more injectors 34 are configured to deliver input droplet 46 of a desired aqueous media on input spot 30 and outlet droplet 48 of a desired aqueous media on output spot 32. In order to generate flow between input spot 30 and output spot 32 along strip 40, it can be understood that the aqueous media must displace a thin layer of oil 24 at the interface of oil 24 and strip 40 come into contact with strip 40. To overcome the energy barrier for the displacement of oil 24 and facilitate the flow of the aqueous media along strip 40, it is contemplated to provide an external perturbation on the interface of oil 24 and strip 40, e.g., utilizing anti-static gun 50. Other mechanisms such as an on-chip micro transducer, a surface acoustic wave generator, and/or paramagnetic beads moved with a magnet may be used to provide the external perturbation on the interface of oil 24 and strip 40, without deviating scope of the present invention.

Figure 3A:
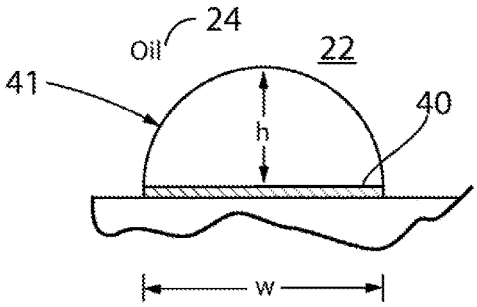
FIG. 3*a* is a cross-sectional view of the open microfluidic system of the present invention taken along line 3*a*-3*a* of FIG. 3.

To generate the external perturbation on the interface of oil 24 and strip 40, anti-static gun 50 is positioned a selected distance, e.g., 5 centimeters, above the upper surface of oil 24. Anti-static gun 50 repetitively pumps streams of ionized air at oil 24 so as to provide alternate positive and negative charges on oil 24. Oil 24 vibrates in response to the repetitive pumping of the ionized air by anti-static gun 50, thus causing a momentum to be applied to the interface of oil 24 and strip 40. This momentum helps the aqueous media overcome the energy barrier for the displacement of oil 24 and allow for the aqueous media to flow along strip 40 to interconnect input spot 30 and output spot 32. The aqueous media along strip 40 defines a microchannel 41 having a height h, a width w and a length, FIG. 3*a*.

In order to generate fluid flow from input spot 30 to output spot 32, injector 34, operatively connected to an aqueous media source 37, may be used to deliver aqueous media to input droplet 46 such that the fluidic pressure in input droplet 46 urges the aqueous media along strip 40 toward output droplet 48. Alternatively, because input droplet 46 has a smaller radius of curvature than output droplet 48, a larger pressure exists on input spot 30. The resulting pressure gradient causes aqueous media to flow from input droplet 46, along strip 40, towards output droplet 48. It can be understood that by sequentially depositing additional drops of aqueous media to input droplet 46 on input spot 30 with injector 34, the resulting pressure gradient will cause the aqueous media to flow along strip 40 towards output droplet 48 on output spot 32. As a result, fluid flows along strip 40 from input droplet 46 to output droplet 48. It can be understood that in addition to generating the flow of aqueous media in system 10 utilizing passive pumping, as heretofore described, other mechanisms (e.g., a syringe pump) may be used without deviating from the scope of the present invention.

Figure 13:
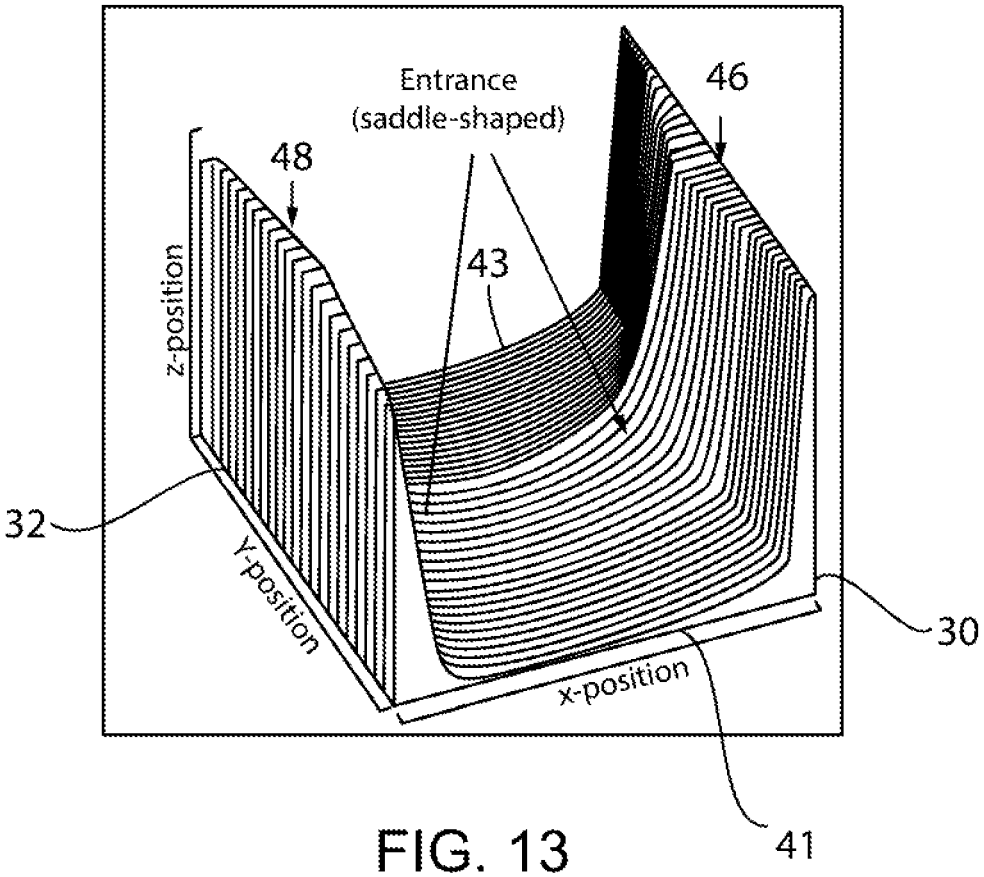
FIG. 13 is a schematic, isometric view of the open microfluidic system of the present invention.

It has been determined that microchannel 41 has a similar height/width (h/w) ratio (e.g., approximately 1:13), which is independent of the width of strip 40. Hence, it can be appreciate that cellular samples flowing in microchannel 41 may be confined within a designated area simply by adjusting a dimension (i.e., either the width or the height) of portion 43 of microchannel 41 to be comparable or smaller than the objects being confined (e.g., a single cell). The small height/width ratio of the open microchannels means confinement of cellular samples can be achieved with microchannels having relatively large widths. In contrast to closed systems, the geometry and effect of surface tension in open systems result in a gradual rather than abrupt channel entrance. This produces a saddle-shaped geometry at the connection of microchannel 41 to input and output spots 30 and 32, respectively, FIG. 13. Due to the unique entrance geometry, cells entering microchannel 41 follow a contour line whose height is comparable to the size of a single cell, named an entrance plume. The entrance plume can affect the constraint of cellular samples in adjacent spots. If the length of a channel is less than two times the length of the entrance plume, then the height at the center of the channel is enough for cells to flow from input spot 30 to output spot 32.

Critical to the function of microfluidic systems is the ability to have flow across multiple scales. To extend the function of open microfluidic systems, it is necessary that the flow rates at both the upper and lower limits (i.e., for maximum and minimum flow respectively) be expanded. Flow is important for many applications in biomedical research where control of mass transport (e.g., a constant drug delivery rate) and/or mechanical cues (e.g., stable shear force on cell-surface adhesion) is necessary. The volumetric flow rate (Q) of fluid in a channel may be calculated according to the expression:

$$\Delta P = R_h Q \qquad \text{Equation (2)}$$

wherein: $\Delta P$ is the pressure drop and $R_h$ is the hydrodynamic resistance.

Given the lack of physical walls in open microfluidic system 10, robust confinement of fluid in open channels can be challenging, especially when high $\Delta P$ is applied. To increase the upper limit of flow rate in open-channel designs, a maximum virtual barrier to the fluid, such as that enabled by double-ELR, is desired. On the other end, to establish a low flow rate, a sufficiently high $R_h$ is necessary to limit convective bulk flow. It can be understood that $R_h$ can be controlled by varying the dimensions of microchannel, either by making microchannel 41 longer or by reducing the cross sectional area thereof. More specifically, for a given resistance, the length of microchannel 41 must be increased exponentially to offset the change in the cross sectional area of microchannel 41. Hence, to establish a low flow rate across a short distance (e.g., a few hundred microns, a typical distance in which capillary exchange occurs in vivo), a reduced cross sectional area is necessary. To maintain $\Delta_{critical}$, and thus a steady flow through microchannel 41, a syringe pump may be utilized to add volume of aqueous media to inlet droplet 46, while simultaneously removing the same volume of aqueous media from outlet droplet 48.

Figure 4:
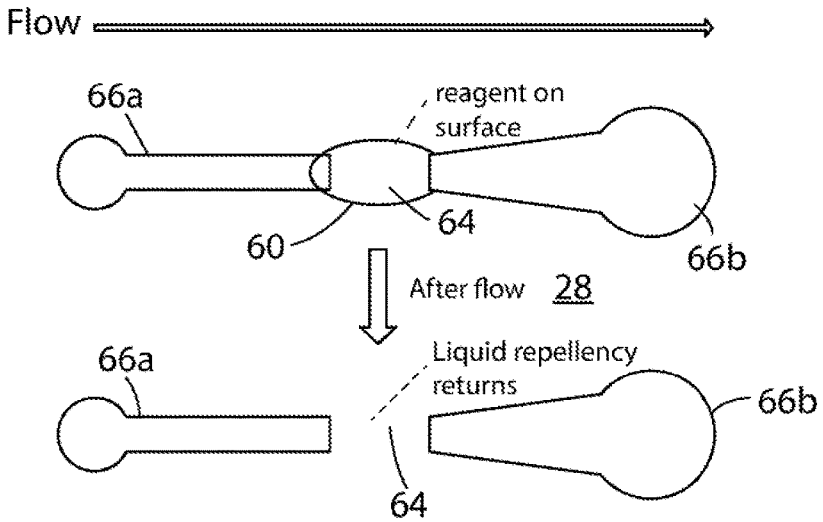
FIG. 4 is a schematic, top plan view of the open microfluidic system of FIG. 1 including a single use valve shown in a first connected position and a second disconnected position.
Figure 5:
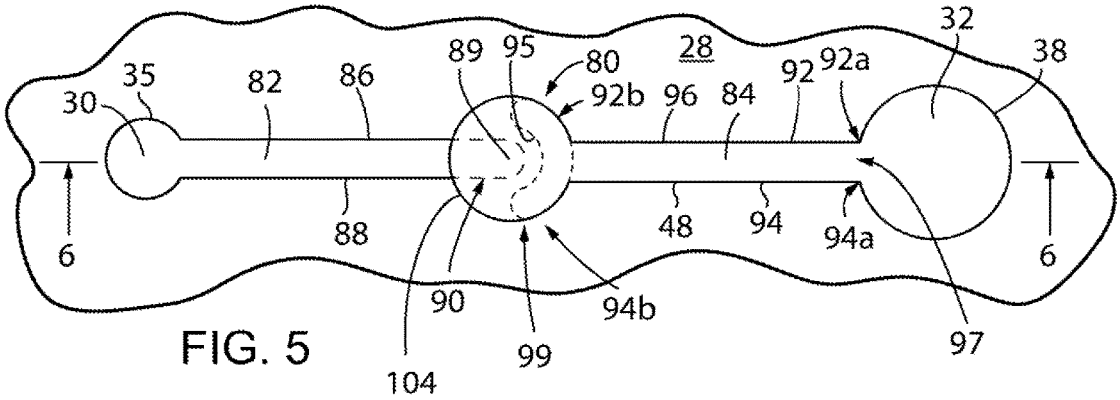
FIG. 5 is a top plan view showing a portion of the open microfluidic system of FIG. 1 including an alternate valve shown in a first connected position.
Figure 6:
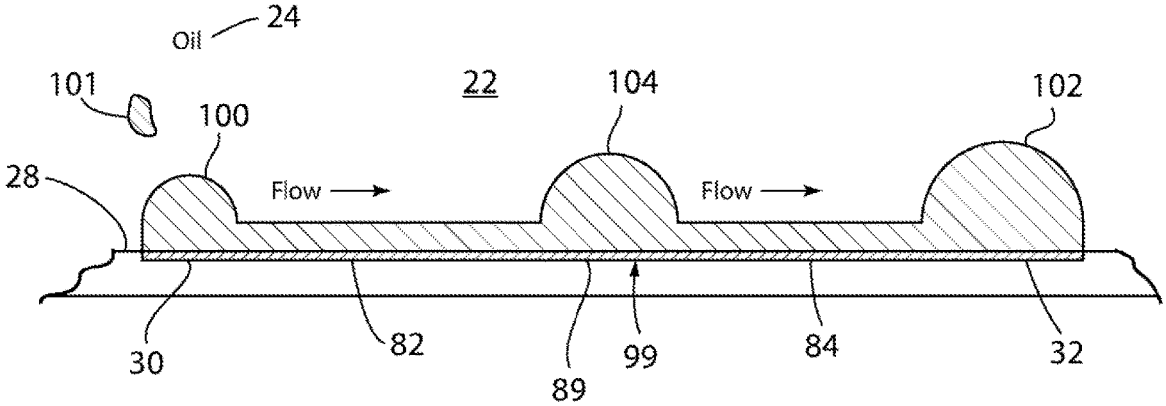
FIG. 6 is a cross-sectional view of the open microfluidic system of the present invention taken along line 6-6 of FIG. 5.

Referring to FIG. 4, it is contemplated for system 10 to include a dissolvable single-use smart "valve." By way of example, strip 40 may be defined by first and second hydrophilic channels 66*a* and 66*b* patterned on ELR surface 28 of microfluidic device 12. With reservoir 22 dry and free of fluids, reagent 60 of interest in solution is deposited onto ELR surface 28 at a location 64 interconnecting first and second hydrophilic channels 66*a* and 66*b*, respectively. Reagent 60 is allowed to dry and physically adsorb onto surface 28. Once reagent 60 is dried on surface 28, reservoir 22 of microfluidic device 12 is filled with a selected fluid, such as oil 24.

With reservoir 22 filled with oil, an aqueous solution of interest may be flowed from first hydrophilic channel 66*a*, over reagent 60 at location 64, to second hydrophilic channel 66*b*, as heretofore described. It can be understood that as the aqueous solution of interest flows from first hydrophilic channel 66*a*, over reagent 60 at location 64, to second hydrophilic channel 66*b*, the aqueous solution of interest picks-up and re-dissolves the desiccated reagent 60 therein so as to carry reagent 60 to second hydrophilic channel 66*b*. Once all the available reagent 60 is dissolved, ELR surface 28 is returned back to a liquid repellent state, thus disconnecting first hydrophilic channel 66*a* from second hydrophilic channel 66*b*. This arrangement allows for reagent 60 at location 64 to act as a valve, serving as both a reagent delivery device and an autonomous self-regulating timer that shuts off liquid flow once all reagent 60 is delivered to second hydrophilic channel 66*b*.

Alternatively, it is contemplated to incorporate a reversible valve into system 10. It can be appreciated that open channels present a unique challenge in the design of reversible valves due to the lack of physical walls whereby a mechanism capable of connecting, disconnecting and reconnecting fluid flow can be easily deployed.

Referring to FIGS. 5-8, an alternate embodiment of a valve is generally designated by the reference numeral 80. By way of example strip 40 may be defined by first and second hydrophilic channels 82 and 84 patterned on ELR surface 28 of microfluidic device 12. First channel 82 extends along an axis and is defined by first and second, generally parallel edges 86 and 88, respectively, which intersect ELR surface 28. First and second edges 86 and 88, respectively, have first ends which intersect boundary 35 of input spot 30 and corresponding second ends which intersect each other and define hydrophilic spot 89 at terminal end 90 of first channel 82. Second channel 84 extends along an axis and is defined by first and second edges 92 and 94, respectively, and concave edge 95 which intersect ELR surface 28. More specifically, first and second edges 92 and 94 respectively, include first ends 92*a* and 94*a*, respectively, which define output end 97 of second channel 84 and intersect boundary 38 of output spot 32. Parallel portions 96 and 98 of first and second edges 92 and 94, respectively, extend from first ends 92*a* and 94*a* and intersect second ends 92*b* and 94*b* of first and second edges 92 and 94, respectively. Second ends 92*b* and 94*b* of first and second edges 92 and 94, respectively, diverge from each other and extend on opposite sides of terminal end 90 of first channel 82. Second ends 92*b* and 94*b* of first and second edges 92 and 94 respectively, are interconnected by concave edge 95 which extends about terminal end 90 of first channel 82. Second ends 92*b* and 94*b* of first and second edges 92 and 94, respectively, and concave edge 95 define a generally horse-shoe-shaped input end 99 of second channel 84.

In operation, reservoir 22 of microfluidic device 12 is filled with a selected fluid, such as oil 24. One of more injectors 34 are configured to deliver input droplet 100 of a desired aqueous media on input spot 30, outlet droplet 102 of a desired aqueous media on output spot 32, and bridge droplet 104 on spot 89 at terminal end 90 of first channel 82. It is intended for bridge droplet 104 to be of sufficient dimension to overlap and communicate with input end 99 of second channel 84 so as to fluidically connected first and second channels 82 and 84, respectively, FIGS. 5-6. It is intended for bridge droplet 104 to fluidically connect first and second channels 82 and 84, respectively, thereby closing valve 80 and allowing for fluid flow therebetween.

In order to generate flow between input spot 30 and output spot 32 along strip 40, it is contemplated to provide an external perturbation on the interface of oil 24 and strip 40 utilizing anti-static gun 50. As heretofore described, oil 24 vibrates in response to the repetitive pumping of the ionized air by anti-static gun 50, thus causing a momentum to be applied to the interface of oil 24 and strip 40. This momentum helps the aqueous media overcome the energy barrier for the displacement of oil 24 and allow for the aqueous media to flow along strip 40 to fluidically connect input droplet 100 on input spot 30 to bridge droplet 104 and to fluidically connect bridge droplet 104 and output droplet 102 on output spot 32. Because input droplet 100 has a smaller radius of curvature than bridge droplet 104, a larger pressure exists on input spot 30. The resulting pressure gradient causes aqueous media to flow from input droplet 100, along first channel 82, towards bridge droplet 104. Similarly, because bridge droplet 104 has a smaller radius of curvature than output droplet 102, a larger pressure exists on spot 89. The resulting pressure gradient causes aqueous media to flow from bridge droplet 104 along second channel 84, towards output droplet 102. It can be understood that by sequentially depositing additional drops 101 of aqueous media to input droplet 100 on input spot 30 with injector 34, the resulting pressure gradient will cause the aqueous media to flow along first channel 82, through bridge droplet 104, along second channel 84 towards output droplet 102 on output spot 32. As a result, fluid flows along strip 40 from input droplet 100 to output droplet 102, FIG. 6.

Figure 7:
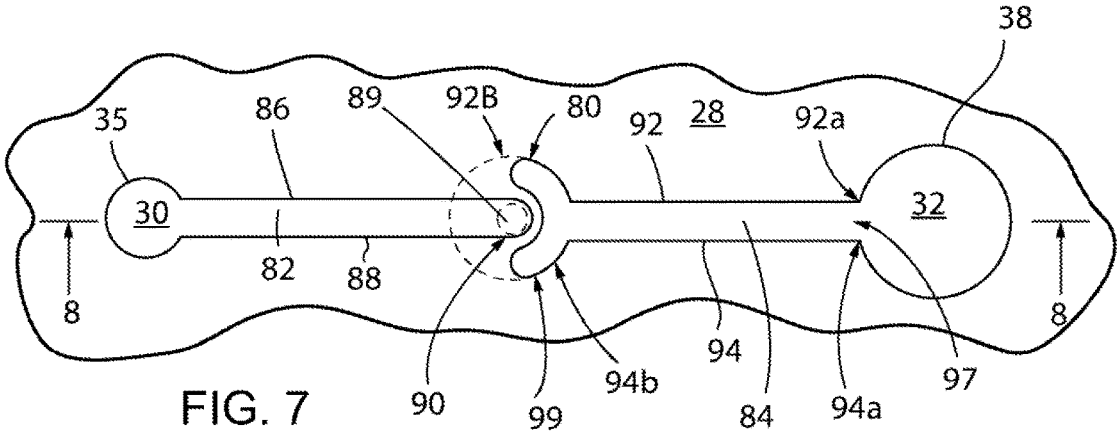
FIG. 7 is a top plan view showing a portion of the open microfluidic system of FIG. 5 including the valve shown in a second disconnected position.
Figure 8:
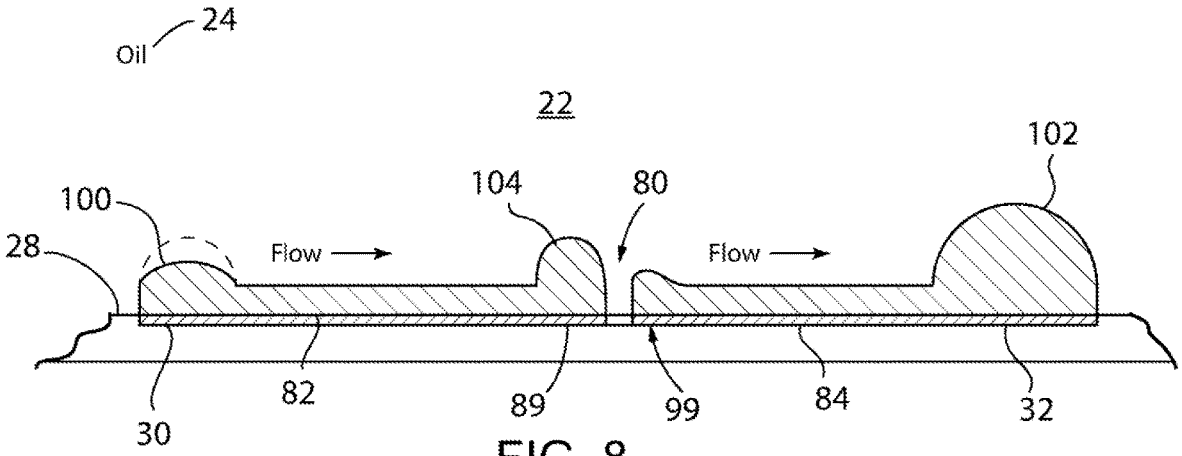
FIG. 8 is a cross-sectional view of the open microfluidic system of the present invention taken along line 8-8 of FIG. 7.
Figure 9:
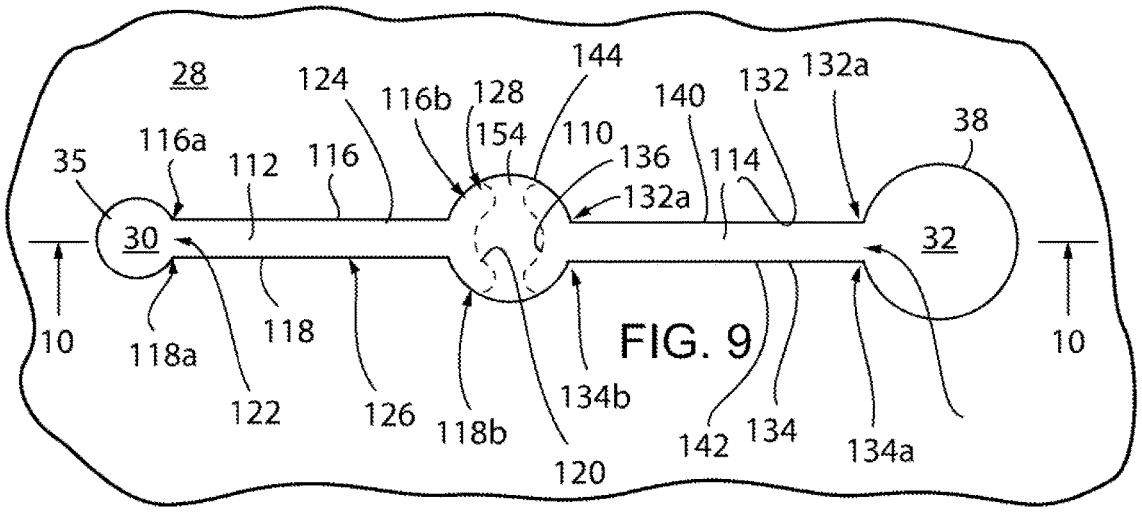
FIG. 9 is a top plan view showing a portion of the open microfluidic system of FIG. 1 including a further alternate valve shown in a first connected position.
Figure 10:
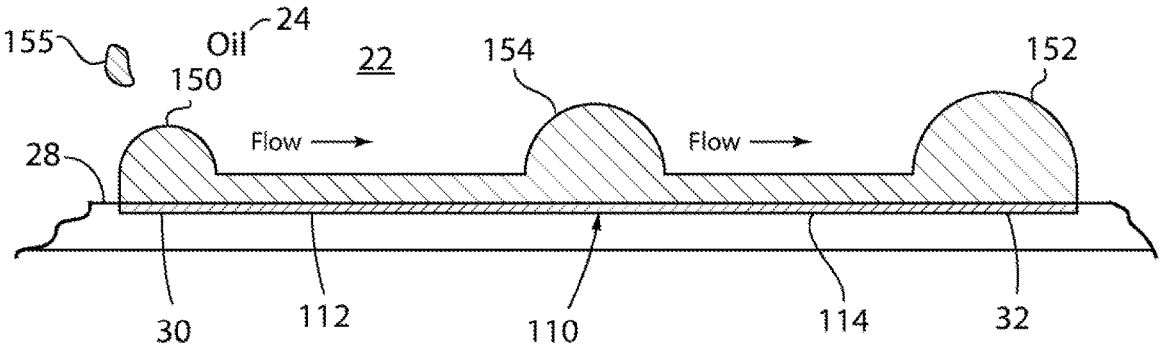
FIG. 10 is a cross-sectional view of the open microfluidic system of the present invention taken along line 10-10 of FIG. 9.

By terminating the depositing of drops 101 of aqueous media, it can be understood that the volume of aqueous media flowing in bridge droplet 104 decreases, while the aqueous media continues to output droplet 102, thereby reducing the dimension of bridge droplet 104, FIGS. 7-8. More specifically, as the dimension abridge droplet 104 is reduced, the volume in bridge droplet 104 reaches a critical point (i.e., the minimum amount of liquid required to maintain the fluidic connection between first and second channels 82 and 84, respectively (hereinafter referred to as "$V_{critical}$"). Once bridge droplet 104 reaches $V_{critical}$, termination end 90 of first channel 82 becomes isolated from input end 99 of second channel 84, thereby opening or disconnecting valve 80 and terminating the fluid flow between input spot 30 and output spot 32 along strip 40. Reinstitution of fluid flow between input spot 30 and output spot 32 along strip 40 may be achieved by simply adding aqueous media to bridge droplet 104 to reestablish a fluidic connection between first and second channels 82 and 84, respectively, and sequentially depositing additional drops 101 of aqueous media on input droplet 100.

It can be understood that $V_{critical}$ is dependent upon the geometry and the size of the portion of ELR surface 28 between termination end 90 of first channel 82 and input end 99 of second channel 84 (hereinafter referred to as the ELR gap). A larger ELR gap requires a larger $V_{critical}$ to maintain the connection between first and second channels 82 and 84, respectively. The connection time ($\Delta t_{connection}$) of valve 80 is defined as the time to reduce the initial volume of bridge droplet 104 ($V_{initial}$) to $V_{critical}$. It can be appreciated that a larger $V_{critical}$ (e.g., a valve with a larger ELR gap) results in a shortened $\Delta t_{connection}$ for a given Q.

It is noted that fluid flow through valve 80 may be reversed by providing outlet droplet 102 with a smaller radius of curvature than bridge droplet 104 and by providing bridge droplet 104 with a smaller radius of curvature than input droplet 100. The resulting pressure gradient causes aqueous media to flow from output droplet 104, along second channel 84, towards bridge droplet 104. Similarly, because bridge droplet 104 has a smaller radius of curvature than input droplet 100, the resulting pressure gradient causes aqueous media to flow from bridge droplet 104, along first channel 82, towards input droplet 100. It can be understood that by sequentially depositing additional drops 101 of aqueous media to outlet droplet 102, the resulting pressure gradient will cause the aqueous media to flow along second channel 84, through bridge droplet 104, along first channel 82 towards input droplet 100. As a result, fluid flows along strip 40 from output droplet 102 to input droplet 100.

Referring to FIGS. 9-12, a still further embodiment of a valve is generally designated by the reference numeral 110. By way of example, strip 40 may be defined by first and second hydrophilic channels 1112 and 114 patterned on ELR surface 28 of microfluidic device 12. First channel 112 extends along an axis and is defined by first and second edges 116 and 118, respectively, and concave edge 120 which intersect ELR surface 28. More specifically, first and second edges 116 and 118, respectively, include first ends 116*a* and 118*a*, respectively, which define input end 122 of first channel 112 and intersect boundary 35 of input spot 30. Parallel portions 124 and 126 of first and second edges 116 and 118, respectively, extend from first ends 116*a* and 118*a* and intersect second ends 116*b* and 118*b* thereof. Second ends 116*b* and 118*b* of first and second edges 116 and 118, respectively, diverge from each other. Second ends 116*b* and 118*b* of first and second edges 116 and 118, respectively, are interconnected by concave edge 120. Second ends 116*b* and 118*b* of first and second edges 116 and 118, respectively, and concave edge 120 define a generally horseshoe-shaped output end 128 of first channel 112.

Second channel 114 extends along an axis and is defined by first and second edges 132 and 134, respectively, and concave edge 136 which intersect ELR surface 28. More specifically, first and second edges 132 and 134, respectively, include first ends 132*a* and 134*a*, respectively, which define output end 138 of second channel 114 and intersect boundary 38 of output spot 32. Parallel portions 140 and 142 of first and second edges 132 and 134, respectively, extend from first ends 132*a* and 134*a* and intersect second ends 1132*b* and 134*b* of first and second edges 1132 and 134, respectively. Second ends 132*b* and 134*b* of first and second edges 132 and 134, respectively, diverge from each other. Second ends 132*b* and 134*b* of first and second edges 132 and 134, respectively, are interconnected by concave edge 136. Second ends 132*b* and 134*b* of first and second edges 132 and 134, respectively, and concave edge 136 define a generally horseshoe-shaped input end 144 of second channel 114. As hereinafter described, it can be appreciated that output end 128 of first channel 112 and input end 144 of second channel 114 may be utilized as valve 110 to terminate fluid flow from input spot 30 and output spot 32 along strip 40.

In operation, reservoir 22 of microfluidic device 12 is filled with a selected fluid, such as oil 24. One of more injectors 34 are configured to deliver input droplet 150 of a desired aqueous media on input spot 30, outlet droplet 152 of a desired aqueous media on output spot 32, and bridge droplet 154 so as to overlap output end 128 of first channel 112 and input end 144 of second channel 114. It is intended for bridge droplet 154 to fluidically connect first and second channels 112 and 114, respectively, thereby closing valve 110 and allowing for fluid flow therebetween.

In order to generate flow between input spot 30 and output spot 32 along strip 40, it is contemplated to provide an external perturbation on the interface of oil 24 and strip 40 utilizing anti-static gun 50. As heretofore described, oil 24 vibrates in response to the repetitive pumping of the ionized air by anti-static gun 50, thus causing a momentum to be applied to the interface of oil 24 and strip 40. This momentum helps the aqueous media overcome the energy barrier for the displacement of oil 24 and allows for the aqueous media to flow along strip 40 to fluidically connect input droplet 150 on input spot 30 to bridge droplet 154 and to fluidically connect bridge droplet 154 and output droplet 152 on output spot 32. Because input droplet 150 has a smaller radius of curvature than bridge droplet 154, a larger pressure exists on input spot 30. The resulting pressure gradient causes aqueous media to flow from input droplet 150, along first channel 112, towards bridge droplet 154. Similarly, bridge droplet 154 has a smaller radius of curvature than output droplet 152, a larger pressure exists on input end 144 of second channel 114. The resulting pressure gradient causes aqueous media to flow from bridge droplet 104, along second channel 114, towards output droplet 152. It can be understood that by sequentially depositing additional drops 155 of aqueous media to input droplet 150 on input spot 30 with injector 34, the resulting pressure gradient will cause the aqueous media to flow along first channel 112, through bridge droplet 154, along second channel 114 towards output droplet 152 on output spot 32. As a result, fluid flows along strip 40 from input droplet 150 to output droplet 152, FIG. 10.

Figure 11:
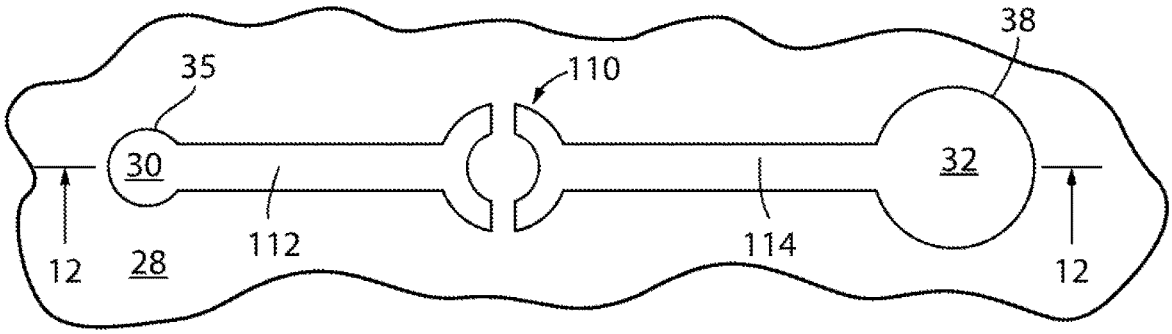
FIG. 11 is a top plan view showing a portion of the open microfluidic system of FIG. 9 including the valve shown in a second disconnected position.
Figure 12:
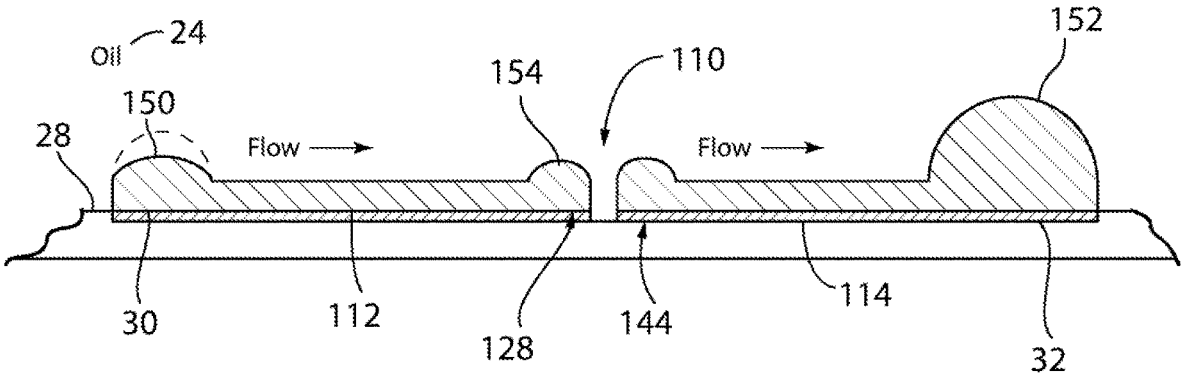
FIG. 12 is a cross-sectional view of the open microfluidic system of the present invention taken along line 12-12 of FIG. 11.

As heretofore described with respect to valve 80, by terminating the depositing of drops 155 of aqueous media, it can be understood that the volume of aqueous media in bridge droplet 154 decreases thereby reducing the dimension thereof, FIGS. 11-12. As the dimension of bridge droplet 154 is reduced to $V_{critical}$, output end 128 of first channel 112 becomes isolated from input end 144 of second channel 114, thereby opening valve 110 and terminating the fluid flow between input spot 30 and output spot 32 along strip 40. Reinstitution of fluid flow between first and second channels 112 and 114, respectively, along strip 40 may be achieved by simply adding aqueous media to bridge droplet 154 to reestablish a fluidic connection between first and second channels 112 and 114, respectively, and sequentially depositing additional drops 155 of aqueous media on input droplet 150. Hence, by simply adding aqueous media to or removing aqueous media from bridge droplet 154, connection or disconnection of valve 110 can be achieved reversibly.

Once again, it is noted that $V_{critical}$ is dependent upon the geometry and the size of the portion of ELR surface 28 between output end 128 of first channel 112 and input end 144 of second channel 114 (hereinafter referred to as the ELR gap). A larger ELR gap requires a larger $V_{critical}$ to maintain the connection between first and second channels 112 and 114, respectively. The connection time ($\Delta t_{connection}$) of valve 1110 is defined as the time to reduce the initial volume of bridge droplet 154 ($V_{initial}$) to $V_{critical}$. It can be appreciated that a larger $V_{critical}$ (e.g., a valve with a larger ELR gap) results in a shortened for a given Q.

It is noted that fluid flow through valve 110 may be reversed by providing outlet droplet 152 with a smaller radius of curvature than bridge droplet 154 and by providing bridge droplet 1104 with a smaller radius of curvature than input droplet 150. The resulting pressure gradient causes aqueous media to flow from output droplet 154, along second channel 114, towards bridge droplet 154. Similarly, because bridge droplet 154 has a smaller radius of curvature than input droplet 150, the resulting pressure gradient causes aqueous media to flow from bridge droplet 154, along first channel 112, towards input droplet 150. It can be understood that by sequentially depositing additional drops 155 of aqueous media to outlet droplet 152, the resulting pressure gradient will cause the aqueous media to flow along second channel 114, through bridge droplet 154, along first channel 112 towards input droplet 150. As a result, fluid flows along strip 40 from output droplet 152 to input droplet 150.

Figure 14:
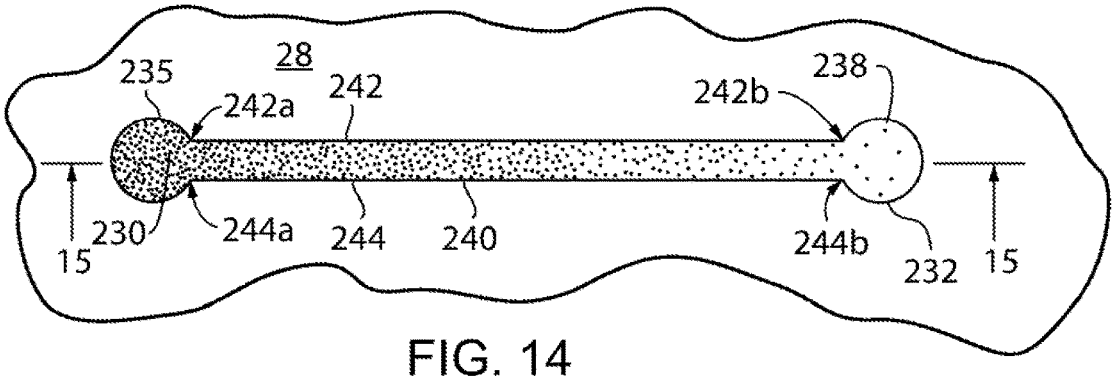
FIG. 14 is a top plan view showing a portion of the open microfluidic system of FIG. 1 utilized to generate an under-oil gradient.
Figure 15:
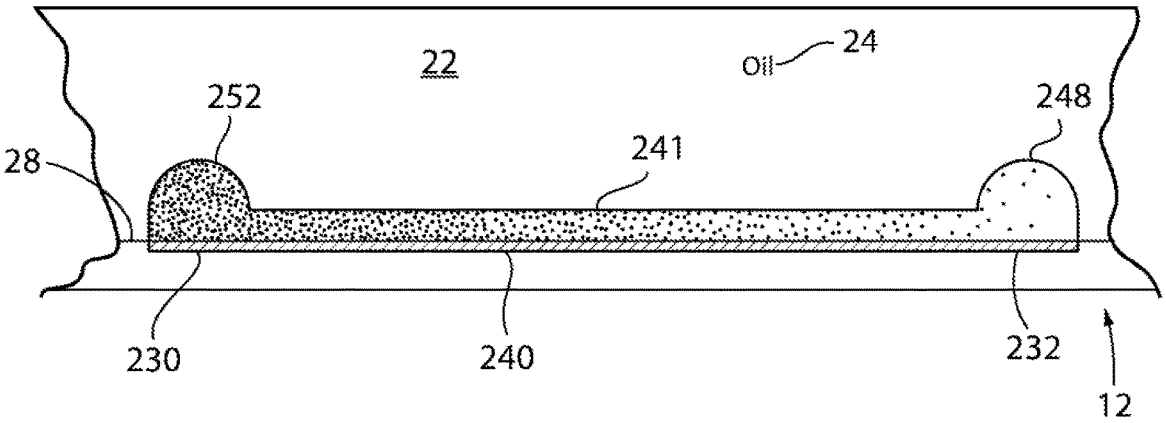
FIG. 15 is a cross-sectional view of the open microfluidic system of the present invention taken along line 15-15 of FIG. 14.

Referring to FIGS. 14-15, it is contemplated for system 10 to include surface patterning provided on ELR surface 28 to allow for the generation of a gradient of particles between a first source region 230 to a second sink region 232 over a predetermined time period (the "gradient development period"). More specifically, in the depicted embodiment, hydrophilic source region 230 is pre-patterned on ELR surface 28 of microfluidic device 12 at a selected first location and a hydrophilic sink region 232 is pre-patterned on ELR surface 28 of microfluidic device 12 at a selected second location, axially spaced from the first location. Source region 230 has an outer periphery intersecting ELR surface 28 at boundary 235. Similarly, sink region 232 has an outer periphery intersecting ELR surface 28 at boundary 238. It is contemplated for sink region 232 to have a cross-sectional area generally equal to a cross-sectional area of source region 230. However, source region 230 and sink region 232 may have other configurations without deviating from the scope of the present invention.

Source region 230 and sink region 232 are interconnected by a hydrophilic strip 240 pre-patterned on and extending axially along ELR surface 28. Strip 240 is defined by first and second, generally parallel edges 242 and 244, respectively, which intersect ELR surface 28. First and second edges 242 and 244, respectively, have corresponding first ends **242*a* and 244*a*, respectively, which intersect boundary 235 of source region 230 and corresponding second ends 242*b* and 244*b*, respectively, which intersect boundary 238 of sink region 32. It is further contemplated for the surface patterning on ELR surface 28 to have other configurations. For example, strip 240 may be wider at second ends 242*b* and 244*b* and narrower at first ends 242*a* and 244*a* to promote passive pumping of an aqueous media in system 10, as heretofore described. In addition, it is contemplated to provide source region 230 and sink region 232, respectively, at different locations along strip 240**, without deviating from the scope of the present invention.

In operation, reservoir 22 of microfluidic device 12 is filled with a selected fluid, such as oil 24. After flooding the reservoir 22 with oil 24, one of more injectors 34, FIG. 1, are configured to deliver first input droplet (no shown) of a desired aqueous media on source region 230 and outlet droplet 248 of a desired aqueous media on sink region 232. Aqueous media is flowed along strip 240, as heretofore described, to interconnect source region 230 and sink region 232, thereby defining microchannel 241 along strip 240 having a height h, a width w and a length.

In order to generate a gradient of particles across microchannel 241 between source region 230 and sink region 232, the convective flow of fluid in microchannel 241 must be minimized. It can be appreciated that a strong convective flow through microchannel 241 will transport the particles through, which reduces the ability to establish a gradient in microchannel 241 over an extended period of time. As such, to generate a gradient, it is necessary to minimize the pressure differential between the inlet of microchannel 241, microchannel 241, and the outlet of microchannel 241. Fox example, to minimize the pressure differential between the inlet of microchannel 241, microchannel 241, and the outlet of microchannel 241, the radii of the curvature of the droplets at the inlet of microchannel 24 and the outlet of microchannel must be maintained as close as possible. The combination of the size of source region 230 and sink region 232 patterned on ELR surface 28 and the volume of the droplets provided on source region 230 and sink region 232, as hereinafter described, determine the local radius of curvature of the droplets. Consequently, it can be understood that size of source region 230 and the size of sink region 232 do not have to be the same, if the volumes of the droplet provided on source region 230 and sink region 232 are different.

In the depicted embodiment, one of more injectors 34 are configured to deliver second input droplet 252 of a desired aqueous media having a known concentration of particles, such as cells, molecules, chemical species, organisms or the like, on source region 230. The particles in second input droplet 252 on source region 230 diffuse into microchannel 241 such that after a predetermined time period, a concentration gradient is created along the length of microchannel 241. It can be understood that an ideal source/sink setup may be achieved by providing source and sink regions 230 and 232, respectively, with volumes that are significantly larger that the volume of microchannel 241. The large volume sink region 232 at the output end of microchannel 241 can help maintain the concentration gradient by not allowing the particles to accumulate in microchannel 241. As such, the source/sink concept heretofore described may be used to create a pseudo-steady state in microchannel 241 wherein the concentration at a point within microchannel 241 does not vary dramatically with time.

Alternatively, it can be appreciated an ideal source/sink setup may be constructed by maintaining by a constant concentration of particles in microchannel 241 by providing an infinite source of particles at source region 230 and by providing a sink region 232 of infinite size. This may be accomplished by providing a steady flow through microchannel 241 utilizing a syringe pump to add volume to second inlet droplet 46, while simultaneously removing the same volume of outlet droplet 248.

Various modes of carrying out the invention are contemplated as being within the scope of the following claims particularly pointing out and distinctly claiming the subject matter that is regarded as the invention.

We claim:

1. An open microfluidic system, comprising:

a microfluidic device including a reservoir adapted for receiving an oil therein, the reservoir defined by a surface configured to repel an aqueous solution;

a hydrophilic input for receiving an input droplet of the aqueous solution thereon and a hydrophilic output for receiving an output droplet of the aqueous solution thereon, the input and the output being patterned on the surface and the output being spaced from the input;

a hydrophilic strip interconnecting the input and the output; and, an injector configured to direct a series of input drops toward the input droplet so as to cause the flow of aqueous solution from the input droplet toward the output droplet along the hydrophilic strip.

2. The system of claim 1 wherein the hydrophilic strip includes a first channel having a first end connected to the input, a second channel having a first end connected to the output, and a valve configured to selectively fluidically connect the second ends of the first and second channel.

3. The system of claim 2 wherein the valve includes a second end of the first channel and a second end of the second channel.

4. The system of claim 3 wherein the valve includes a dried reagent fluidically interconnecting the second end of the first channel and the second end of the second channel, wherein fluid flowing over the dried reagent picks-up and re-dissolves the dried reagent therein, thereby exposing a portion of the surface between the first and second hydrophilic channels and fluidically isolating the first channel from the second channel.

5. The system of claim 3 wherein the second end of the second channel has a horseshoe configuration.

6. The system of claim 5 wherein the second end of the first channel has a horseshoe configuration.

7. An open microfluidic system, comprising a microfluidic device including a reservoir adapted for receiving an oil therein, the defined by a surface configured to repel an aqueous solution, a hydrophilic input and a hydrophilic output patterned on the surface, the output spaced from the input;

a hydrophilic strip interconnecting the input and the output, the hydrophilic strip including a first channel having a first end connected to the input, a second channel having a first end connected to the output, and a valve including a second end of the first channel and a second end of the second channel, the valve configured to selectively fluidically connect the second ends of the first and second channel;

and a droplet having a first dimension wherein the droplet communicates with the second end of the first channel and the second end of the second channel thereby closing the valve and a second dimension wherein the droplet fluidically isolates the second end of the first channel from the second end of the second channel thereby opening the valve.

8. The system of claim 1 wherein the hydrophilic strip includes an area having a reduced dimension.

9. A method of fabricating an open microfluidic system, comprising the steps: providing a microfluidic device including a reservoir defined by a surface configured to repel an aqueous solution; patterning a hydrophilic input, a hydrophilic output and a hydrophilic strip interconnecting the input and output on the surface; filling the reservoir with an oil; positioning an input droplet of the aqueous solution on the input and an output droplet of the aqueous solution on the output; fluidically connecting the input droplet and the output droplet along the hydrophilic strip with the aqueous solution; and directing a series of input drops toward the input droplet so as to cause the flow of the aqueous solution from the input droplet toward the outlet droplet along the hydrophilic strip.

10. A method of fabricating an open microfluidic system, comprising the steps:

providing a microfluidic device including a reservoir defined by a surface configured to repel an aqueous solution;

patterning a hydrophilic input, a hydrophilic output and a hydrophilic strip interconnecting the input and output on the surface;

filling the reservoir with an oil;

positioning an input droplet of the aqueous solution on the input and an output droplet of the aqueous solution on the output; and fluidically connecting the input droplet and the output droplet along the strip with the aqueous solution;

wherein the step of fluidically connecting the input droplet and the output droplet along the strip includes the step of generating an external perturbation on the oil in the reservoir.

11. The method of claim 10 wherein the external perturbation on the oil is generated by an anti-static gun, the anti-static gun repetitively pumping ionized air at the oil.

12. The method of claim 9 wherein the hydrophilic strip includes a valve, the valve having a first open configuration fluidically isolating the input from the output and a second closed configuration wherein the input and the output are in fluidic communication.

13. The method of claim 12 wherein the hydrophilic strip includes a first channel has a first end connected to the input and a second channel having a first end connected to the output, the valve configured to selectively fluidically connect the first and second channels.

14. The method of claim 13 wherein the valve includes a second end of the first channel and a second end of the second channel.

15. The method of claim 14 wherein the valve includes a dried reagent fluidically interconnecting the second end of the first channel and the second end of the second channel.

16. The method of claim 15 comprising the additional step of a flowing a fluid over the dried reagent to picks-up and re-dissolve the dried reagent therein so as to expose a portion of the surface between the first and second hydrophilic channels and open the valve.

17. The method of claim 14 wherein the second end of the second channel has a horseshoe configuration.

18. The method of claim 17 wherein the second end of the first channel has a horseshoe configuration.

19. A method of fabricating an open microfluidic system, comprising the steps:

providing a reservoir defined by a surface configured to repel an aqueous solution;

patterning a hydrophilic input, a hydrophilic output and a hydrophilic strip interconnecting the input and output on the surface; filling the reservoir with an oil; positioning an input droplet of the aqueous solution on the input and an output the aqueous solution on the output; and fluidically connecting the input droplet and the output droplet along the hydrophilic strip with the aqueous solution, wherein:

the hydrophilic strip includes a valve, the valve having a first open configuration fluidically the input from the output and a second closed configuration wherein the input output are in fluidic communication; the hydrophilic strip includes a first channel having a first end connected to the input and a second having a first end connected to the output, the valve configured to selectively connect the first and second channels; the valve includes a second end of the first channel and a second end of the second the valve includes a droplet having a first dimension wherein the droplet communicates with the second end of the first channel and the second end of the second channel thereby closing the valve and a second dimension wherein the droplet fluidically isolates the second end of the first channel form the second end of the second channel thereby opening the valve.

20. The method of claim 9 including the steps of:

reducing a dimension of the hydrophilic strip so as to define a capture area; and capturing a desired particle in the capture area.

21. The method of claim 9 including the of adjusting a dimension of the hydrophilic strip, wherein the dimension of the hydrophilic strip corresponds to a flow rate of the aqueous solution along the strip.

22. The method of claim 9 wherein the input droplet of the aqueous solution has a concentration of particles therein, the particles diffusing into the aqueous solution along the hydrophilic strip to form a gradient of particles in the aqueous solution along the hydrophilic strip.

23. A single-use valve, comprising:

a microfluidic device including a reservoir defined by a surface configured to repel an aqueous solution, the reservoir configured for receiving oil therein;

first and second hydrophilic channels patterned on surface, the first hydrophilic channel being spaced from and fluidically isolated from the second hydrophilic channel; and a dried reagent deposited on the surface and interconnecting the first and second hydrophilic channels so as to fluidically connect the first and second hydrophilic channels;

wherein fluid flowing over the dried reagent picks-up and re-dissolves the dried reagent therein, thereby exposing a portion of the surface between the first and second hydrophilic channels, disconnecting the first and second hydrophilic channels, and fluidically isolating the first hydrophilic channel from the second hydrophilic channel.

* * * * *